US007234253B2

(12) United States Patent
Ossmann

(10) Patent No.: US 7,234,253 B2
(45) Date of Patent: Jun. 26, 2007

(54) ADVERTISING/PROMOTIONAL DISPLAY SYSTEM WITH INTEGRAL SOUND GENERATING MEANS

(75) Inventor: Francis J. Ossmann, Old Lyme, CT (US)

(73) Assignee: Structural Graphics, LLC, Essex, CT (US)

( * ) Notice: Subject to any disclaimer, the term of this patent is extended or adjusted under 35 U.S.C. 154(b) by 0 days.

(21) Appl. No.: 11/394,267

(22) Filed: Mar. 30, 2006

(65) Prior Publication Data

US 2006/0207135 A1 Sep. 21, 2006

Related U.S. Application Data

(63) Continuation of application No. 10/657,990, filed on Sep. 9, 2003, now abandoned.

(60) Provisional application No. 60/411,698, filed on Sep. 17, 2002.

(51) Int. Cl.
*G09F 1/00* (2006.01)

(52) U.S. Cl. ..... 40/124.14; 40/124.03; 446/488

(58) Field of Classification Search ..... 40/124.03, 40/124.08, 124.14, 455, 717; 446/488
See application file for complete search history.

(56) References Cited

U.S. PATENT DOCUMENTS 3,267,597 A * 8/1966 Jannes ..... 40/584
4,607,747 A * 8/1986 Steiner ..... 206/232
4,790,714 A * 12/1988 Schnapp ..... 446/486
4,794,024 A * 12/1988 Crowell et al. ..... 428/12
5,275,285 A * 1/1994 Clegg ..... 206/449
5,319,454 A * 6/1994 Schutte ..... 725/6
5,577,918 A * 11/1996 Crowell ..... 434/319
5,778,547 A * 7/1998 Wolken ..... 33/427
5,983,538 A * 11/1999 Crowell ..... 40/124.14
6,104,306 A * 8/2000 Hogue et al. ..... 340/686.1

FOREIGN PATENT DOCUMENTS

FR 2717776 A3 * 9/1995

* cited by examiner

*Primary Examiner*—Joanne Silbermann
(74) *Attorney, Agent, or Firm*—Melvin I. Stoltz

(57) ABSTRACT

By providing a pre-printed housing member which automatically expands from a flat, generally two-dimensional configuration into a three-dimensional promotional display and also incorporating a sound generator which is activated simultaneously with the movement of the display member from its substantially flat, planar configuration into its three-dimensional configuration, a unique, hands-on, printed, visually exciting and interest-generating, advertising/promotional product is obtained. In the preferred embodiment, an audio producing circuit is automatically activated simultaneously with the automatic movement of the display member from its two-dimensional configuration into its three-dimensional configuration. In this way, a visually exciting, interest generating, multi-sense impacting, advertising/promotional display member is realized.

18 Claims, 3 Drawing Sheets

ADVERTISING/PROMOTIONAL DISPLAY SYSTEM WITH INTEGRAL SOUND GENERATING MEANS

This application is a continuation application of U.S. patent application Ser. No. 10/657,990, filed Sep. 9, 2003 entitled ADVERTISING/PROMOTIONAL DISPLAY SYSTEM WITH INTEGRAL SOUND GENERATING MEANS (now abandoned) which is related to U.S. Provisional Patent Application Ser. No. 60/411,698, filed Sep. 17, 2002 entitled ADVERTISING/PROMOTIONAL DISPLAY SYSTEM WITH INTEGRAL SOUND GENERATING MEANS.

TECHNICAL FIELD

This invention relates to advertising and promotional display systems and, more particularly, to advertising/promotional display systems which are movable between a substantially flat configuration and a three-dimensional, erect configuration and provide a multi-sense, interest generating display.

BACKGROUND ART

With the ever increasing quantity of products and services being offered to consumers, substantial interest has been given to promotional systems for advertising such products and services. In this regard, a wide variety of advertising displays and promotional literature has been created and distributed to consumers. However, due to the deluge of material to which average consumers are constantly exposed, greater emphasis has been placed upon developing eye-catching, visual displays and promotional material which will receive consumer attention.

Although various novelty products and printed displays have been created in an attempt to satisfy this demand, these prior art products have failed to provide the desired interest generating result with production costs which advertisers are capable of justifying. In attempting to generate a unique advertising display, some prior art products have employed complex folding systems which produce a three-dimensional display when activated or unfolded. However, in spite of the unique visual appearance generated by such products, the overall cost of production and complexity of assembly of these systems has prevented such prior art systems from becoming popular.

Other prior art displays have attempted to generate consumer interest by providing unique visual images or other indicia as an integral part of the display. However, these prior art attempts have also failed to generate the consumer interest being sought, largely due to an inability to physically involve the consumer in the promotion or display.

Therefore, it is a principal object of the present invention to provide a printed advertising or promotional product which is capable of being produced at a reasonable cost and provides an exciting, interest-generating display.

Another object of the present invention is to provide a printed advertising or promotional product having the characteristic features described above, which enables the consumer to physically control the presentation of the display in a unique hands-on manner.

Another object of the present invention is to provide a printed advertising or promotional product having the characteristic features described above which is capable of mass production and assembly.

A further object of the present invention is to provide a printed advertising or promotional product having the characteristic features described above which provides a unique, eye-catching, exciting and surprising display which is produced in response to action by the consumer.

Other and more specific objects will in part be obvious and will in part appear hereinafter.

SUMMARY OF THE INVENTION

By employing the present invention, all of the difficulties and inabilities of the prior art are eliminated and a unique, hands-on, printed, visually exciting and interest-generating advertising/promotional product is obtained. These desirable results are achieved in the present invention by providing a unique, preprinted housing member which automatically expands from a flat, generally two-dimensional configuration into a three-dimensional promotional display. In addition, in order to further enhance the excitement and interest generated by the promotional product of the present invention, sound generating means are incorporated in the promotional display member and are activated simultaneously with the movement of the display member from its substantially flat, planar configuration into its three-dimensional configuration.

In accordance with the present invention, a housing is provided which is constructed for automatic, self-initiated, pop-up or erection from a first, substantially flat, two-dimensional configuration into a second, erect three-dimensional configuration. Although prior art constructions of this general nature exist, the present invention provides substantially enhanced interest generating features which are unique to this promotional field. In accordance with the present invention, the self-erecting, promotional display member incorporates an audio producing circuit which is automatically activated simultaneously with the movement of the display member from its two-dimensional configuration into its three-dimensional configuration.

In the present invention, the visually exciting, interest generating, advertising/promotional display member comprises a multi-paneled component formed in either a rectangular or a polygonal shape, with selected panels interconnected to each other in order to enable the display member to be storable in a substantially flat configuration and, when activated, automatically expand or pop-up into a three-dimensional configuration. In order to provide the automatic movement of the display member from its two-dimensional configuration into its three-dimensional configuration, elastic or spring-biasing means are mounted within the display member, interconnected by cooperating panels thereof.

In this way, as is typically found in prior art constructions, the elastic means is maintained in tension when the display member is in its two-dimensional configuration, thereby causing the display member to automatically move into its three-dimensional configuration, when activated, due to the tension or spring forces of the elastic member. In addition, although the tension forces of the elastic means are reduced, the elastic means is still maintained under some tension, in order to assure that the three-dimensional display member is maintained in its fully erect configuration.

In the present invention, each panel forming the display member incorporates an eye-catching visual display for generating consumer interest in the particular product for which the display has been created. In this way, once the display member has been formed into its fully erect, three-dimensional configuration, all of the panels forming the display member are presented in an easily viewable position, adjacent to each other, in order to provide the eye-catching, visually exciting and interest generating material contained thereon.

In accordance with the present invention, consumer interest and excitement is substantially enhanced and greater attention for the display member of the present invention is realized by incorporating into the display member audio circuitry which is automatically activated upon movement of the display member from its first, substantially flat configuration into its second, fully erect, three-dimensional configuration. By simultaneously impacting two important senses of an individual, namely sight and sound, a unique, exciting, and interest generating product is realized which immediately gains attention of every individual in a manner which has been previously unattainable.

In order to provide activation of the audio circuitry simultaneously with the movement of the advertising/promotional display member of the present invention, an elongated arm member is mounted within the display member having a first end which cooperates with on/off switch means formed in the audio circuit. In addition, a second end is affixed to one of the panels of the display member.

In this way, when the display member is in its first, substantially flat configuration, the first end of the arm member is mounted in cooperating relationship with the on/off switch means to prevent activation of the audio circuit. However, whenever the display member is moved from its first, substantially flat configuration into its second, fully erect, three-dimensional configuration, the second end of the elongated arm member causes the entire arm member to simultaneously move, with the first end of the arm member becoming disengaged from blocking contact of the on/off switch means. As a result, the switch means is able to become engaged and activate the audio circuit.

In this way, the desired audio message retained in the audio circuit is played simultaneously with the movement of the display member from its planar configuration to its three-dimensional configuration. As a result, substantial excitement and interest in the promotional/advertising display member is achieved.

In the preferred embodiment, the audio circuit is constructed with the desired audio message being consistent with the product being promoted and the images printed on the panels of the display member. In this way, a fully integrated, coordinated, multi-sense display member is realized which is capable of satisfying advertisers' demands for a new, unique, interest generating promotional product.

The invention accordingly comprises an article of manufacture possessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

DETAILED DISCLOSURE

Figure 1:
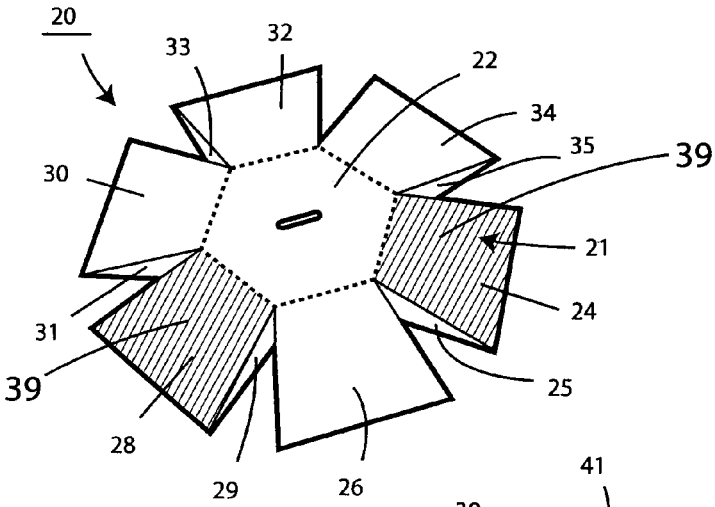
FIG. 1 is a perspective view of one embodiment of the advertising/promotional display member of the present invention shown in its collapsed, substantially planar configuration.

By referring to FIGS. 1-12, along with the following detailed discussion, the construction and operation of two alternate embodiments for the present invention can best be understood. In addition, further alternate embodiments and constructions can be implemented using the teaching of the present invention. Consequently, it is to be understood that the following detailed disclosure and the specific embodiments shown herein are provided for exemplary purposes only and are not intended as a limitation of the present invention.

As shown in FIGS. 1-6, advertising/promotional display system 20 of the present invention comprises housing 21 which is constructed to form a three-dimensional polyhedron, configured in the illustrated example as a hexagon. In the preferred construction, housing 21 comprises upper panel 22, and lower panel 23, both of which are formed in a hexagonal shape. In addition, housing 21 also comprises a pair of cooperating side panels 24, 25, which are affixed to each other along one edge, with side panels 24 affixed to one edge of upper panel 22 while side panel 25 is affixed to one edge of lower panel 23.

In order to complete the desired hexagonal construction, housing 21 incorporates five additional sets of side panel pairs, namely side panels 26 and 27, 28 and 29, 30 and 31, 32 and 33, and 34 and 35. In each instance, one edge of each pair of side panels are affixed to each other, while one side panel is affixed along one edge to upper panel 22 with the adjacent panel affixed to one edge of lower panel 23. By employing this construction, housing 21 is capable of being collapsed into a substantially flat, two-dimensional configuration, while also being quickly and easily expanded from the flat configuration into a three-dimensional configuration, in the form of a hexagon.

Figure 5:
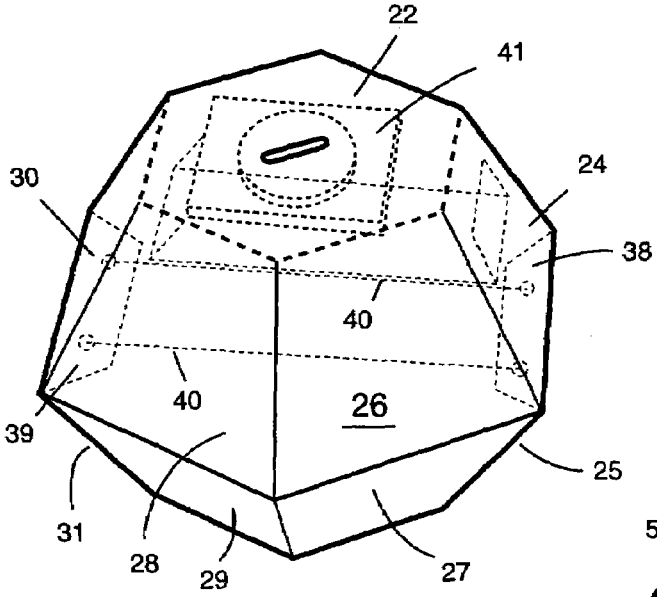
FIG. 5 is a perspective view of the advertising/promotional display member of FIG. 1 shown in its fully erect, three-dimensional configuration.

In order to enable housing 21 to be automatically movable from its first, substantially flat configuration into its second, fully erect, three-dimensional configuration, housing 21 incorporates internally mounted flanges 38 and 39, which are independently mounted in housing 21 on opposite, diametrically opposed side panels. As depicted in FIG. 5, internal flange 38 is mounted at the juncture between side panels 24 and 25, while internal flange 39 is mounted at the juncture between diametrically opposed side panels 30 and 31.

In addition, in order to provide the desired spring force for automatically moving housing 21 from its substantially flat, two-dimensional configuration into its fully erect, three-dimensional configuration, elastic means 40 is mounted in housing 21, extending between internal flanges 38 and 39. Although any desired spring biasing member may be employed to perform this function, the preferred embodiment employs elastic bands or rubber bands which extend between internal flanges 38 and 39 to provide the desired housing erecting force, as well as the required force for maintaining housing 21 in its fully erect position.

As discussed above, elastic bands 40 are secured to internal flanges 38 and 39 in a manner which assures that the tension force provided by elastic band 40 is maximized when housing 21 is in its fully collapsed position. As a result, once any holding force is removed, the tension force provided by elastic bands 40 causes internal flanges 38 and 39 to be drawn towards each other, thereby automatically causing housing 21 to transform from its first, substantially flat, two-dimensional configuration into its second, fully erect, three-dimensional configuration. In addition, elastic bands 40 are also constructed to be maintained under a reduced level of tension when in the second, fully erect position, thereby assuring that housing 21 is maintained in its second, fully erect, three-dimensional configuration.

As discussed above, self-erecting, polygonal shaped members of the general construction detailed above have been produced in the prior art. However, in the present invention, a unique, interest-generating, visually exciting display member 20 is achieved which is capable of simultaneously stimulating two separate and independent senses of an individual. In order to achieve the second sense stimulation, display member 20 of the present invention incorporates audio producing circuit 41 mounted within housing 21 of display member 20.

Although audio producing circuit 41 may be constructed in a wide variety of alternate configurations, the preferred embodiment employs printed circuit board 42 which incorporates all of the components necessary to generate an audio signal which delivers any desired pre-recorded audio message. In addition, speaker 43 is connected to printed circuit board 42, for receiving the audio signal and delivering the audio signal in a manner which can be readily heard and understood by the user or observer. Finally, audio producing circuit 41 comprises on/off switch 44 integrally interconnected with printed circuit board 42 for controlling the activation and deactivation of the audio signal producing components thereof.

In the preferred construction, audio producing circuit 41 is securely mounted within housing 21 of display member 20 by employing interior panel or plate 45. As depicted, interior plate 45 is securely affixed to upper panel 22, with circuit board 42 affixed to one surface thereof and speaker 43 sandwiched between the opposed surface of plate 45 and upper surface 22. In this way, audio producing circuit 41 is secured in the precisely desired location for enabling the audio message contained thereon to be delivered whenever activated.

In the preferred configuration, audio producing circuit 41 is constructed with a pre-recorded message which may comprise words, music, sounds, etc., either independently or in association with each other. In providing an audio message, the message may consist of enunciated words or sounds which are consistent with the images printed on the panels forming housing 21, shown in FIG. 1 as indicia 89. In this way, a fully integrated visual and audible display member 20 is realized. However, depending upon the type of impact desired by the sponsor of display member 20, audio producing circuit 41 may comprise any desired audio message deemed appropriate by the sponsor.

Figure 2:
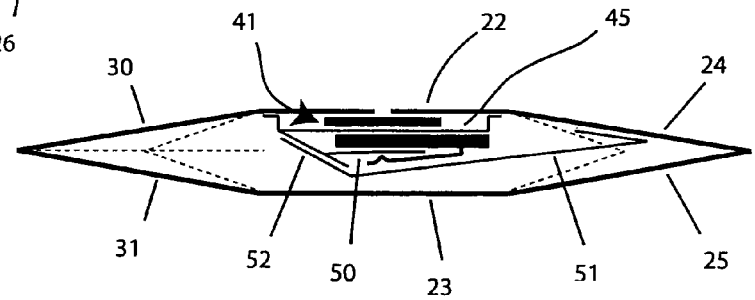
FIG. 2 is a cross-sectional side elevation view of the advertising/promotional display member of FIG. 1.
Figure 3:
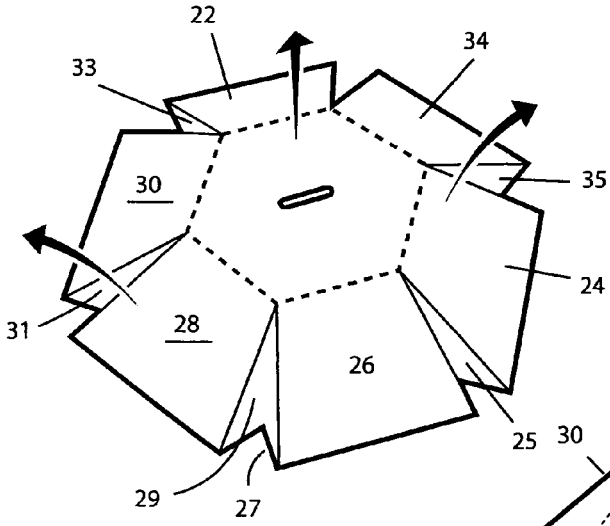
FIG. 3 is a perspective view of the advertising/promotional display member of FIG. 1 shown in the process of moving from its collapsed configuration to its fully erect configuration.
Figure 4:
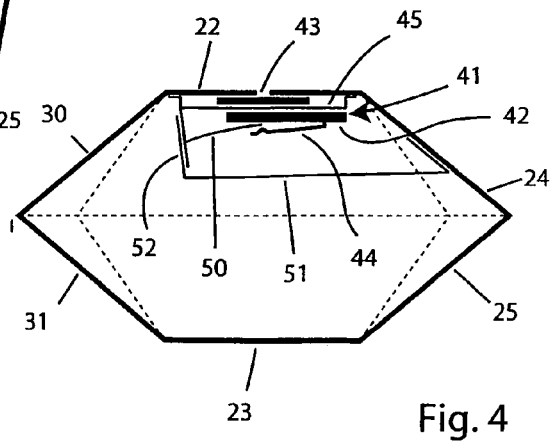
FIG. 4 is a cross-sectional, side elevation view of the advertising/promotional display member of FIG. 3.
Figure 6:
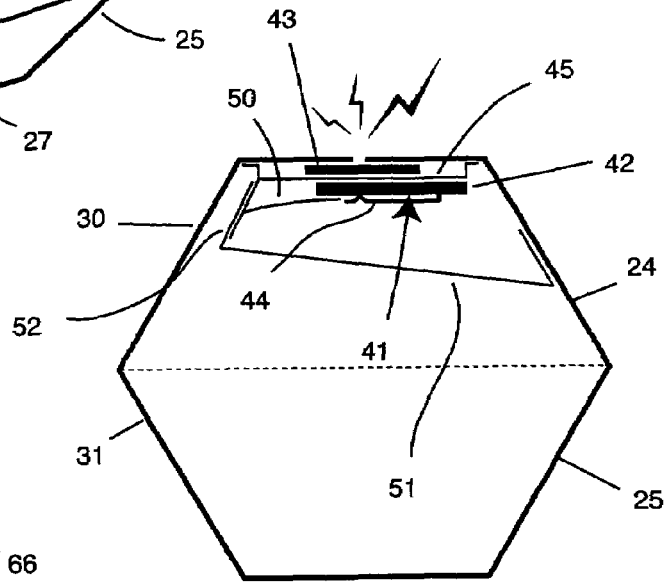
FIG. 6 is a cross-sectional side elevation view of the advertising/promotional display member of FIG. 5.

As best seen in FIGS. 2, 4, and 6, audio producing circuit 41 is mounted within housing 21 of display member 20 in a manner which assures that audio producing circuit 41 is simultaneously activated with the movement of display member 20 from its first, substantially flat, two-dimensional configuration (FIG. 2) into its second, fully erect, three-dimensional configuration (FIG. 6). In order to achieve this controlled, simultaneous activation of audio producing circuit 41, arm member 50 is mounted in housing 21, in cooperating association with uniquely constructed and strategically positioned support panels or plates 51 and 52.

In achieving interest generating, eye-catching, and multi-sense stimulating, advertising/promotional display member 20, it is important that audio producing circuit 41 is activated to generate the desired audio message substantially simultaneously with the activation of housing 21 from its first, substantially flat, collapsed position into its second, fully erect, three-dimensional position. By providing an integrated, cooperating circuit activation system the desired, unique, multi-sense impacting promotional display member 20 is realized.

In order to assure simultaneous activation of audio producing circuit 41 with the movement of housing 21, support panels or plates 51 and 52 are mounted in housing 21 by securely affixing support panels or plates 51 and 52 to each other, and also affixing each support panel or plate 51 and 52 to separate, independent panel members of housing 21. In addition, support panels or plates 51 and 52 are constructed for being retained in a first, substantially flat configuration, wherein said support panels or plates 51 and 52 are substantially aligned with and co-planar to the compacted panels forming housing 21 when in its first position. In their second configuration, support panels or plates 51 and 52 angularly extend relative to each other and are positioned in spaced relationship to the interior panels forming housing 21 when in its three-dimensional, fully erect position. In addition, arm member 50 is cooperatively associated with support panels or plates 51 and 52 with one end of arm member 50 being affixed to support panel or plate 52, while the opposed end of arm member 50 is cooperatively associated with switch means 44 of audio producing circuit 41.

In achieving the desired, operation, arm member 50 is positioned between the contacts forming on/off switch means 44, preventing activation of audio producing circuit 41, whenever support panels or plates 51 and 52 are in their first, substantially planar position. In addition, when housing 21 is activated for movement from its first position to its second position, support panels or plates 51 and 52 are constructed for arcuately pivoting inwardly from the collapsed position to their fully assembled position wherein support panels or plates 51 and 52 extend into the interior of housing 21.

This arcuate movement of support panels or plates 51 and 52 from a collapsed configuration to a fully assembled configuration causes arm member 50 to move simultaneously therewith, since one end of arm member 50 is affixed to support panel or plate 52. This movement of arm member 50 causes arm member 50 to be withdrawn from engagement between the contacts forming on/off switch 44, enabling the contacts to engage each other and cause audio producing circuit 41 to be activated. As a result, the precisely desired activation of audio producing circuit 41 is achieved simultaneously with the movement of housing 21 from its collapsed position to its fully erect position.

In the preferred construction, support panels or plates 51 and 52 preferably comprise two cooperating portions or sections, with one section of each support panel being securely affixed to the independent panel members of housing 21. In addition, the other portions or sections of support panels or plates 51 and 52 extend into the interior of housing 21 with the terminating ends thereof being secured to each other. In this way, the cooperative movement of panels or plates 51 and 52 is achieved, along with the controlled movement of arm member 50 relative to switch means 44.

As shown in FIGS. 2, 4, and 6, the construction detailed above in regard to arm member 50, support panel or plate 51, and support panel or plate 52 is achieved by constructing support panel or plate 51 as a first elongated support panel or plate incorporating sections 54, 55, 56, all of which are sequentially interconnected to each other. In addition, support panel or plate 52 is constructed as a second elongated support panel or plate incorporating first section 57 and second section 58 which are interconnected to each other.

In addition, in the preferred embodiment, section 54 of support panel or plate 51 comprises a first section and is affixed to the inside surface of side panel 24 of housing 21, while section 55 and 56 form a second section and extend into the interior of housing 21 and are capable of pivoting movement relative to section 54. Similarly, second section 58 of support panel or plate 52 is affixed to the inside surface of upper panel 22 of housing 21 while first section 57 extends into the interior of housing 21 and is capable of pivoting movement relative to section 58. In the preferred construction, first section 57 of support panel or plate 52 is affixed to section 56 of the second section of support panel or plate 51 in order to assure that elongated support panels or plates 51 and 52 operate simultaneously as a single, integrated component. Finally, arm member 50 is affixed to first section 57 of second support panel or plate 52 in order to move simultaneously with the movement of fist support panel or plate 51 and second support panel or plate 52. As is evident from the foregoing detailed discussion, advertising/promotional display member 20 achieves an eye-catching, interest generating multi-sense impacting, promotional display member by providing a visually exciting, self-erecting, three-dimensional housing which produces a precisely controlled and desired audio message simultaneously with the movement of the housing from a first collapsed, substantially planar position to a second, fully erect, three-dimensional position. In this way, all of the difficulties and drawbacks encountered with prior art constructions have been eliminated and an advertising/promotional display member is achieved which satisfies a long-felt consumer need.

In FIGS. 7-12, a second embodiment of the present invention is depicted wherein display member 20 comprises a self-erecting cube member which incorporates audio producing circuit 41, cooperating arm member 50, and support panels or plates 51 and 52. In the preferred construction, display member 20 is movable from a first, substantially planar configuration, wherein display member 20 comprises the visual appearance of a substantially flat book, into a second, fully erect, three-dimensional configuration wherein display member 20 comprises a cube-shape, the exterior surfaces of which incorporate a desired, visually exciting, and interest generating appearance.

In achieving the simultaneous activation of audio producing circuit 41 with the movement of display member 20 from its first position to its second position, the overall construction and components detailed above in reference to FIGS. 1-6 have been incorporated into the display member depicted in FIGS. 7-12. In this way, the desired dual sense impacting, eye-catching, interest generating and exciting advertising/promotional display member 20 of the present invention is realized in this alternate configuration, as well as any other desired shape or configuration.

In the preferred construction of this embodiment of the present invention, housing 21 comprises square shaped panels 65, 66, 67, and 68 formed adjacent to each other and interconnected to each other along one edge. In addition, housing 21 also comprises substantially triangular shaped panel members 69 and 70 forming both opposed ends of housing 21, with each of the triangular shaped end members being interconnected to adjacent, cooperating square shaped panel members. By employing this construction, housing 21 is capable of being folded into the substantially flat, book shaped configuration, depicted in FIG. 7, while also being deployable from its substantially flat configuration into the fully erect, cube-shaped configuration depicted in FIG. 11.

In order to achieve the self-erecting construction desired for this embodiment of the present invention, housing 21 incorporates interior flanges 71 and 72, which are mounted in housing 21 in opposed corners thereof. As shown, interior flange 71 is mounted along the juncture between panels 67 and 68, while flange 72 is mounted at the juncture of panels 65 and 66. In addition, flanges 71 and 72 are interconnected to each other by spring means 73, which are preferably in the form of elastic bands.

Figure 7:
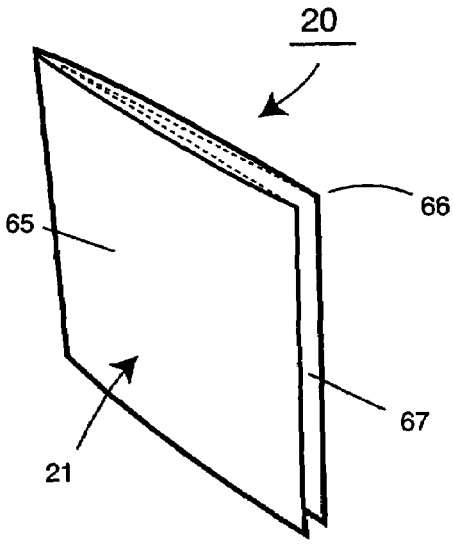
FIG. 7 is a perspective view of an alternate embodiment of the advertising/promotional display member of the present invention shown in its collapsed substantially planar configuration.
Figure 8:
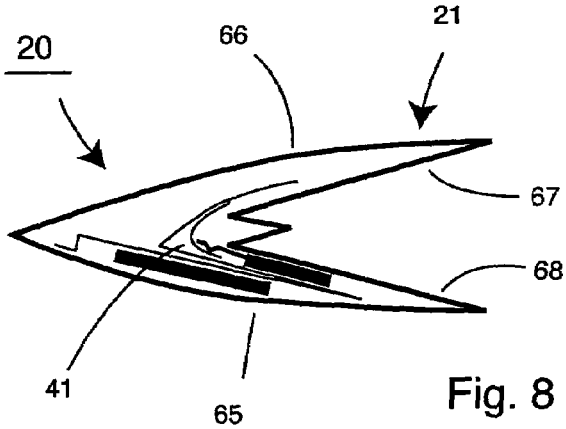
FIG. 8 is a cross-sectional side elevation view of the advertising/promotional display member of FIG. 7.
Figure 9:
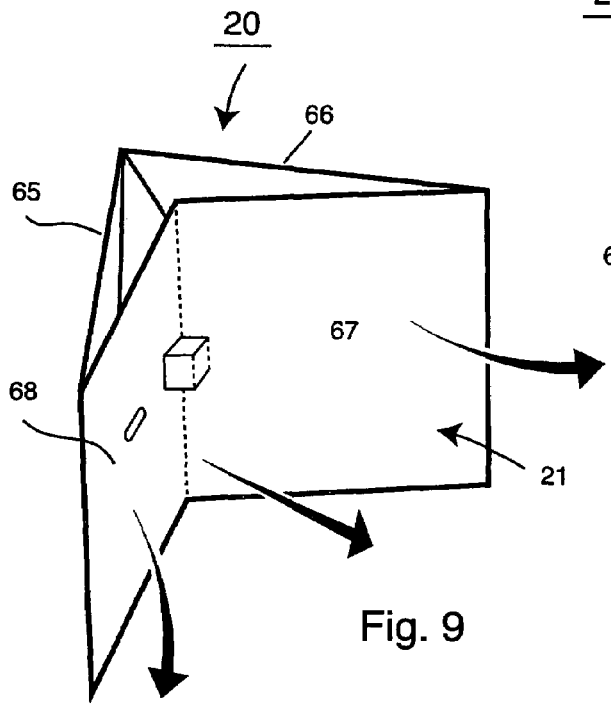
FIG. 9 is a perspective view of the advertising/promotional display member of FIG. 7 shown in the process of moving from its collapsed configuration to its fully erect configuration.
Figure 10:
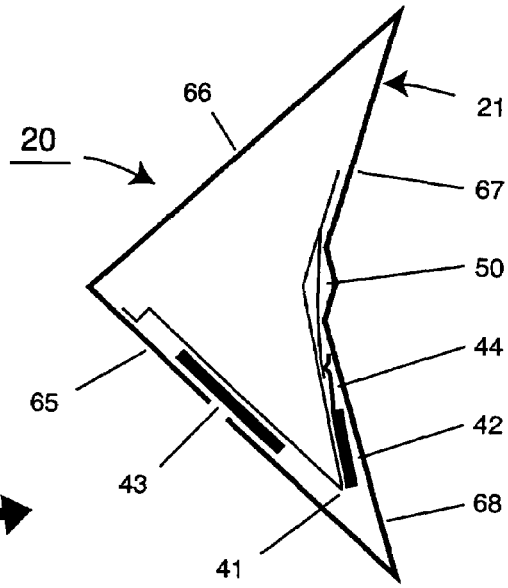
FIG. 10 is a cross-sectional, side elevation view of the advertising/promotional display member of FIG. 9.
Figure 12:
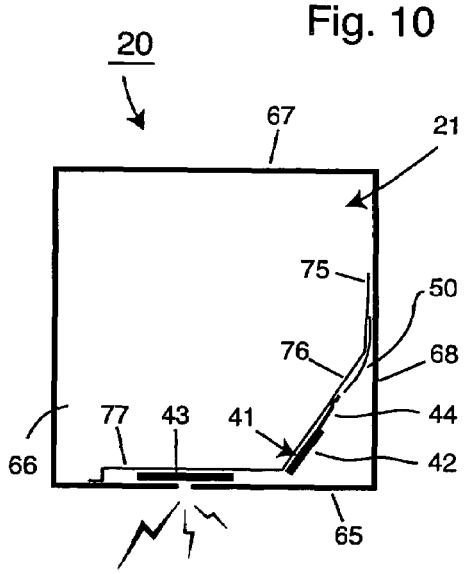
FIG. 12 is a cross-sectional side elevation view of the advertising/promotional display member of FIG. 11.
Figure 11:
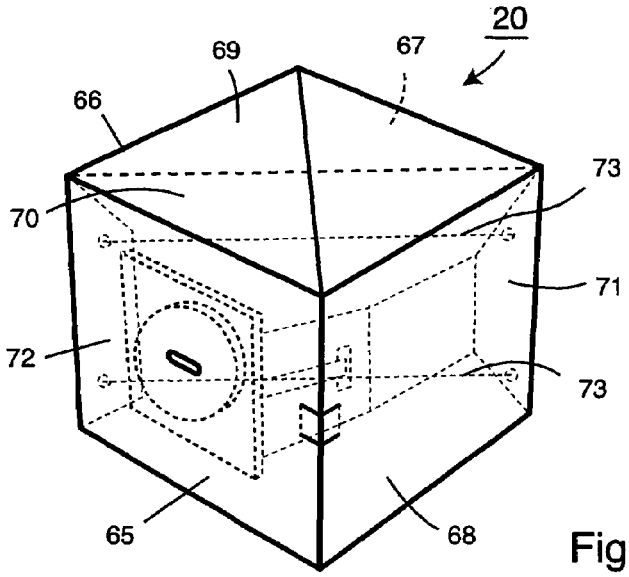
FIG. 11 is a perspective view of the advertising/promotional display member of FIG. 7 shown in its fully erect, three-dimensional configuration.

By employing this construction, the automatic, self-erecting, operation detailed above is achieved in a visually exciting cube shaped construction. Once panels 65 and 66 are pivoted from their generally flat configuration, as shown in FIG. 7, a sufficient arcuate distance to enable spring means 73 to be activated, housing 21 is automatically transformed from a substantially flat, book-shaped visual appearance into a fully erect, three-dimensional, cube-shaped construction. This automatic self erecting result is achieved by the forces provided by spring means 73 acting upon flanges 71 and 72, causing flanges 71 and 72 to be drawn towards each other. In addition, once fully erected, spring means 73 maintains housing 21 in its fully erect, three-dimensional configuration.

In addition to providing the visually exciting, and interest generating, self-activating or self erecting construction detailed above, display member 20 of the present invention also provides the simultaneous activation of audio producing circuit 41 as an integral component of the self-erecting construction. In this way, the user realizes both a visual and audible message simultaneously.

In order to activate audio producing circuit 41 simultaneously with the movement of housing 21 from its first, substantially planar configuration into its second, three-dimensional configuration, arm member 50 and supporting panels 75, 76, and 77 are employed for supporting audio producing circuit 41, as well as activating arm member 50. During the activation process, the overall operation detailed above in reference to the embodiment depicted in FIGS. 1-6 is employed. In this way, by maintaining arm 50 in blocking engagement with the contacts of on/off switch 44 when housing 21 is in its first, substantially planar configuration, while also withdrawing arm 50 from blocking engagement of on/off switch 44 during the self-erecting operation, audio producing circuit 41 is automatically activated, to provide the precisely desired, pre-recorded message contained therein. As a result, unique, visually exciting and interest generating, dual purpose results are realized and advertising/promotional display member 20 is achieved providing enhanced benefits which had previously been incapable of being attained.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. An advertising/promotional display system, constructed for providing an interest-generating, multi-sense, exciting display, comprising A. a housing comprising a. a plurality of co-operating panels, each of said panels comprising an outside surface and an inside surface, b. a first, elongated support plate comprising 1. a first section affixed to an inside surface of a first panel comprising one of the panels forming the housing, 2. a second section extending from the first section into the interior of the housing independently of any other member and terminating with a first free end, and 3. being movable between a collapsed position and an extended position; and;

c. a second, elongated support plate comprising 1. a first section affixed to an inside surface of a second panel comprising one of the panels forming the housing, 2. a second section extending from the first section into the interior of the housing independently of any other member and terminating with a second free end, said second free end being affixed to the first free end of the second section of the first elongated support plate, and 3. being movable between a collapsed position and an extended position, B. a biasing member connected to the housing for causing said panels to move from a first, collapsed, substantially flat configuration, to a second, erect, three-dimensional configuration;

C. an audio signal generating assembly, a. mounted to said housing, b. constructed for producing a desired audio signal when activated, and c. incorporating a switch member movable between an OFF position and an ON position and constructed for controlling the activation and deactivation of the audio signal generating assembly; and D. an arm member, a. mounted at one end thereof directly to the second section of the first support plate affixed to the first panel of the housing for movement therewith when said panels move from the first configuration to the second configuration, and b. controllably engaged at the opposed end thereof with the switch member of the audio signal generating assembly for maintaining the switch member in its OFF position when the housing is in its first, collapsed configuration, and enabling the switch member to move into its ON position in response to the movement of the support plate when the housing moves into its second, erect configuration;

whereby the movement of the housing from the first, substantially flat configuration into the second, erect configuration simultaneously causes a desired audio signal to be generated, thereby enhancing the interest and excitement achieved by the advertising/promotional display system.

2. The advertising/promotional display system defined in claim 1, wherein the outside surface of the panels incorporate indicia printed thereon for providing a desired visual impact or display.

3. The advertising/promotional display system defined in claim 2, wherein the plurality of panels forming the housing are further defined as being cooperatively associated with each other for enabling the housing to be movable between a first, substantially flat configuration and a second, erect, substantially three-dimensional configuration.

4. The advertising/promotional display system defined in claim 3, wherein said housing is further defined as comprising a three-dimensional shape when in the second configuration, with said second configuration comprising one selected from the group consisting of rectangles, cubes, and polyhedrons.

5. The advertising/promotional display system defined in claim 3, wherein said audio signal generating assembly is further defined as comprising an integrated circuit containing a pre-recorded, desired audible message and a speaker for enabling the audible message to be easily heard.

6. The advertising/promotional display system defined in claim 5, wherein said integrated circuit and said speaker are further defined as being mounted to an interior surface of one or more of the panels forming the housing.

7. The advertising/promotional display system defined in claim 5, wherein said pre-recorded audible message is further defined as being directly related to the indicia formed on the outside surface of the panels of the housing, thereby providing an exciting, interest-generating display system wherein both the visual and audible information delivered to the user are consistent.

8. The advertising/promotional display system defined in claim 5, wherein the pre-recorded, audible message is further defined as comprising at least one selected from the group consisting of words, music, and sounds.

9. The advertising/promotional display system defined in claim 3, wherein said biasing member is further defined as comprising an elongated, movable, spring-force generating member mounted under tension between two juxtaposed, spaced, co-operating panel members of said housing for exerting a biasing force against said panels, causing said panels to move towards each other when activated, thereby enabling said housing to be movable between the first, substantially flat configuration and the second, erect, three-dimensional configuration.

10. The advertising/promotional display system defined in claim 9, wherein the spring-force generating member is further defined as being maintained under tension when the housing is in the second, erect, three-dimensional configuration, thereby assuring the housing remains in said three-dimensional configuration.

11. The advertising/promotional display system defined in claim 10, wherein the spring-force generating member is further defined as comprising one selected from the group consisting of elastic bands and rubber bands.

12. The advertising/promotional display system defined in claim 11, wherein said first support plate and said second support plate are further defined as being cooperatively associated with each other for assuring the desired movement of the support plates is attained whenever the housing is moved between the first configuration and the second configuration, providing the desired controlled movement of both support plates within the interior of the housing.

13. The advertising/promotional display system defined in claim 1, wherein the first and the second support plates are further defined as being constructed for cooperating with each other to maintain the arm member in engagement with the switch member when the housing is in the first, collapsed, substantially two-dimensional configuration and controllably withdrawing the arm member from engagement with the switch member when the housing is moved into the second, erect, three-dimensional configuration.

14. The advertising/promotional display system defined in claim 1, wherein said first support plate is defined as extending from said first panel of the housing and the second support plate is defined as extending from a second panel comprising one of the panels forming the housing which is positioned directly adjacent to the first panel, and the ends of said first support plate and second support plate are affixed to each other.

15. An advertising/promotional display system, constructed for providing an interest-generating, multi-sense, exciting display, comprising A. a housing comprising
  a. a plurality of co-operating panels each of said panels having an outside surface and an inside surface, with the outside surface of each panel member incorporating indicia printed thereon for providing a desired visual impact or display; and
  b. a first separate and independent elongated support plate comprising
    1. a first section affixed to an inside surface of a first panel comprising one of the panels forming the housing,
    2. a second section extending from the first section into the interior of the housing independently of any other member and terminating with a first free end, and
    3. being movable between a collapsed position and an extended position; and
  c. a second separate and independent elongated support plate comprising
    1. a first section affixed to an inside surface of a second panel comprising one of the panels forming the housing,
    2. a second section extending from the first section into the interior of the housing independently of any other member and terminating with a second free end, said second free end being affixed to the first free end of the second section of the first elongated support plate, and
    3. being movable between a collapsed position and an extended position;

B. a biasing member connected to the housing for causing said panels to move from a first, collapsed, substantially flat configuration, to a second, erect, three-dimensional configuration and comprising an elongated, movable, spring-force generating member mounted under tension between two juxtaposed, spaced, co-operating panel members of said housing for exerting a biasing force against each of the panels, causing each of the panels to move towards each other when activated, thereby enabling said housing to be movable between a first, substantially flat configuration and a second, erect, three-dimensional configuration;

C. an audio signal generating assembly,
  a. mounted to said housing,
  b. constructed for producing a desired audio signal when activated,
  c. incorporating a switch member movable between an OFF position and an ON position and constructed for controlling the activation and deactivation of the audio signal generating assembly; and
  d. comprising an integrated circuit containing a pre-recorded, desired audible message and a speaker for enabling the audible message to be easily heard; and D. an arm member,
  a. mounted at one end thereof directly to the first support plate for movement therewith when said panels move from the first configuration to the second configuration, and
  b. controllably engaged at the opposed end thereof with the switch member of the audio signal generating assembly for maintaining the switch member in its OFF position when the housing is in the first, collapsed configuration, and enabling the switch member to move into its ON position in response to the movement of the first and second support plates when the housing moves into the second, erect configuration;

whereby the movement of the housing from the first, substantially flat configuration into the second, erect configuration simultaneously causes a desired audio signal to be generated, thereby enhancing the interest and excitement achieved by the advertising/promotional display system.

16. The advertising/promotional display system defined in claim 15, wherein said pre-recorded audible message is further defined as being directly related to the indicia formed on the outside surface of the panels of the housing, thereby providing an exciting, interest-generating display system wherein both the visual and audible information delivered to the user are consistent.

17. The advertising/promotional display system defined in claim 15, wherein the first support plate and the second support plate are further defined as being constructed for maintaining the arm member in engagement with the switch member when the housing is in the first, collapsed, substantially two-dimensional configuration and controllably withdrawing the arm member from engagement with the switch member when the housing is moved into the second, erect, three-dimensional configuration.

18. The advertising/promotional display system defined in claim 17, wherein said first support plate and the second support plate are further defined as being cooperatively associated with each other for assuring the desired movement of the support plates is attained whenever the housing is moved between the first configuration and the second configuration.

* * * * *